US006210302B1

(12) United States Patent
Globus

(10) Patent No.: US 6,210,302 B1
(45) Date of Patent: Apr. 3, 2001

(54) EXERCISING DEVICE AND METHOD OF USING SAME

(76) Inventor: Karin R. Globus, P.O. Box 58302, St. Petersburg, FL (US) 33715

( * ) Notice: Subject to any disclaimer, the term of this patent is extended or adjusted under 35 U.S.C. 154(b) by 0 days.

(21) Appl. No.: 09/236,732

(22) Filed: Jan. 25, 1999

Related U.S. Application Data

(62) Division of application No. 08/687,262, filed on Jul. 25, 1996, now abandoned, which is a continuation of application No. 08/379,097, filed on Jan. 26, 1995, now abandoned, which is a division of application No. 08/014,692, filed on Feb. 8, 1993, now abandoned.

(51) Int. Cl.[7] ..... A63B 15/00
(52) U.S. Cl. ..... 482/37; 482/44; 482/106
(58) Field of Search ..... 482/93, 106–108, 482/44–46, 37, 109, 79; 601/121, 27; 606/237; D24/212

(56) References Cited

U.S. PATENT DOCUMENTS

| | | | | |
|---|---|---|---|---|
| D. 119,035 | * | 2/1940 | Lindgren | D21/197 |
| 2,082,829 | * | 6/1937 | Gerlofson | 601/27 |
| 2,104,927 | * | 1/1938 | Hussman | D21/197 |

* cited by examiner

*Primary Examiner*—Glenn E. Richman

(57) ABSTRACT

A hand-holdable exercising device is provided in the form of an elongated member having a central portion tapering into oppositely facing handle and end knob portions. The elongated member, in its mostly preferred form, is generally cylindrical in cross-sectional shape and superficially resembles two baseball bats joined together end-to-end with their handle portions facing oppositely from each other. In an alternatively preferred embodiment, means are provided for selectively varying the weight of the exercising device. Various exercises also are disclosed for manipulating the member while walking or standing in place.

9 Claims, 5 Drawing Sheets

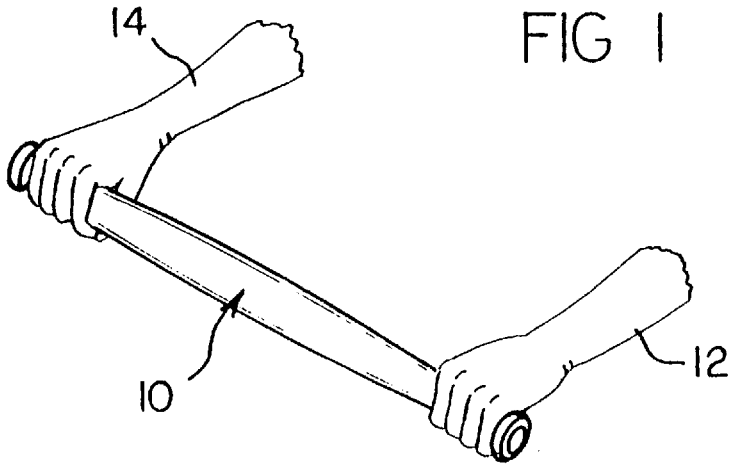
FIG 1
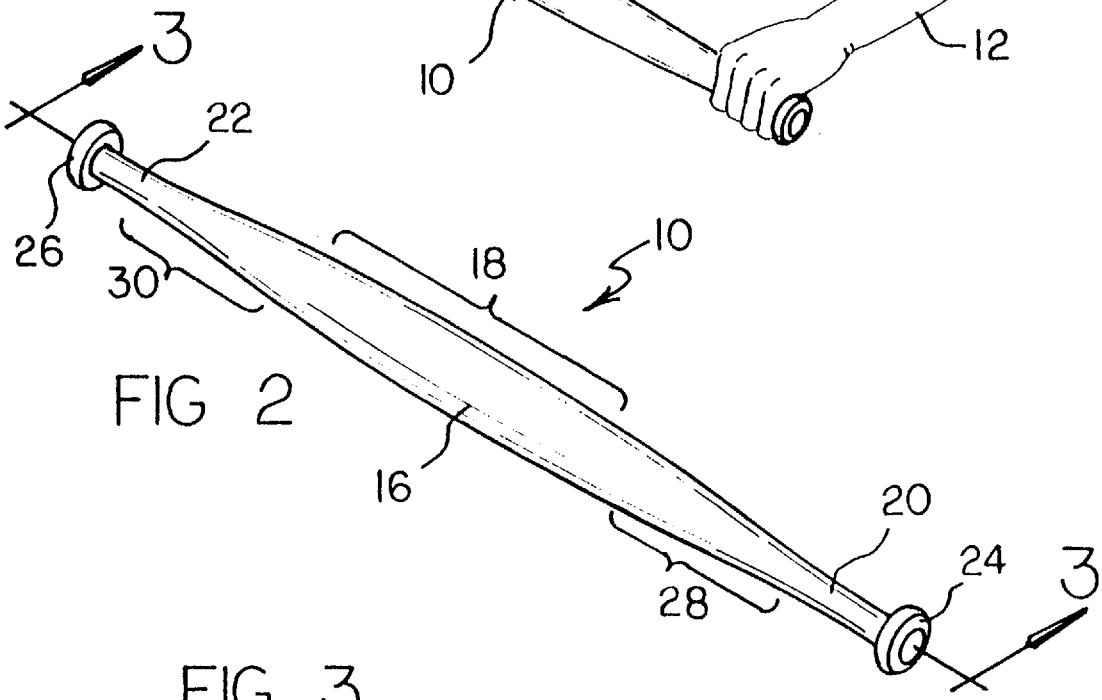
FIG 2
FIG 3
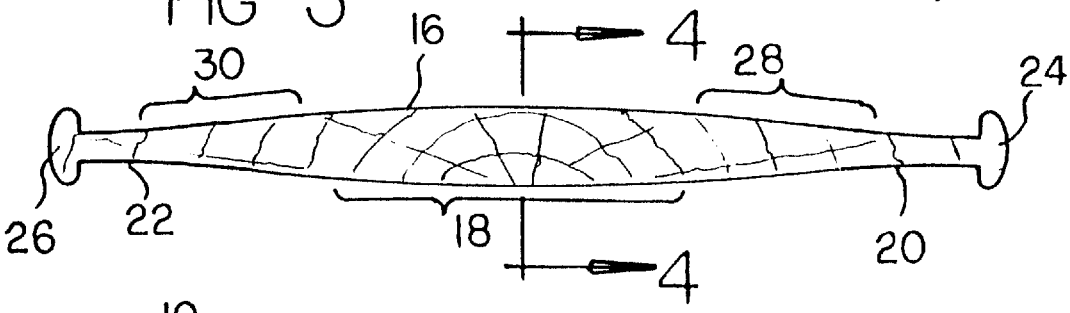
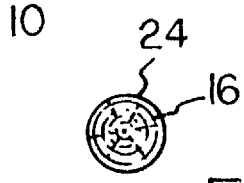
FIG 4

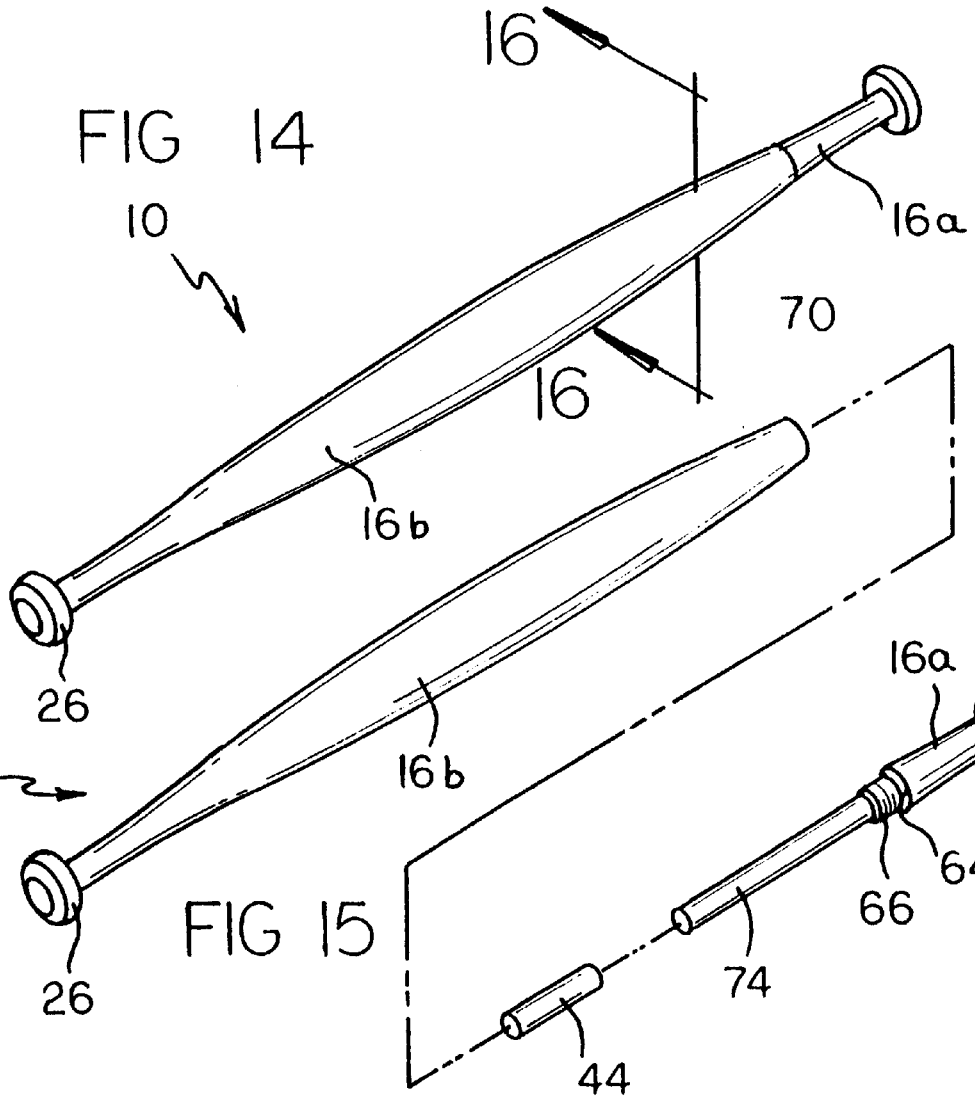
FIG 14
FIG 15
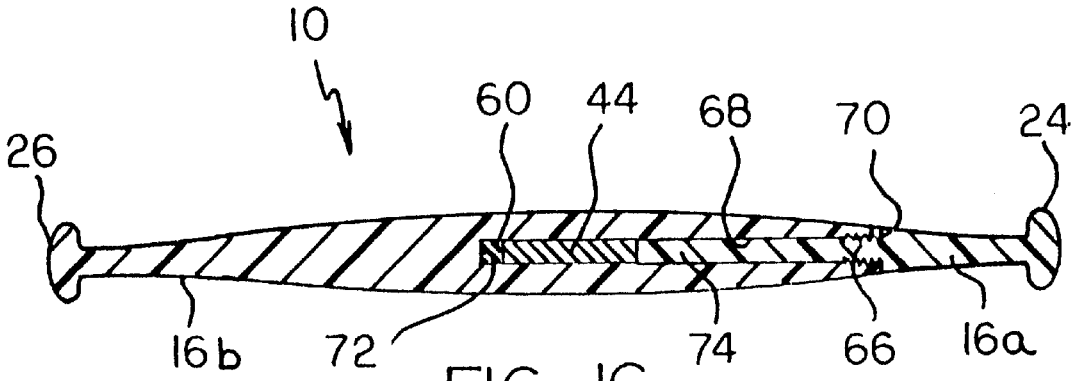
FIG 16

EXERCISING DEVICE AND METHOD OF USING SAME

RELATED APPLICATION

This application is a divisional application of my prior application Ser. No. 08/687,262, filed Jul. 25, 1996, now abandoned, which in turn is a continuation of Ser. No. 08/379,097, Jan. 26, 1995, now abandoned, which in turn is a division of Ser. No. 08/014,692, filed Feb. 8, 1993, now abandoned.

BACKGROUND OF THE INVENTION

1. Field of the Invention

The present invention relates generally to exercising devices, and more particularly, to a new and improved hand-holdable exercising implement which when used in accordance with various exercises improves body tone, aerobic endurance, strength and self-confidence of the exercising individual.

2. Description of the Prior Art

It is generally well known to perform physical exercises using weights. Free weights and various resistance-producing machines are widely employed to enhance various muscle groups, increase muscular bulk and improve strength. It is also well known to engage in aerobic exercises such as walking and running while carrying weights in one or both hands, wearing a weighted belt or back pack, wearing weighted shoes, etc.

Thus, while the foregoing body of prior art indicates it to be well known to use weights in one form or another while exercising, the provision of a more simple and cost effective device and exercising method still is needed. Such need is fulfilled by the present invention as will be made apparent from the following description thereof. Other advantages of the present invention over the prior art also will be rendered evident.

SUMMARY OF THE INVENTION

To achieve the foregoing and other advantages, the present invention, briefly described, provides a hand-holdable exercising device in the form of an elongated member having a central portion tapering into oppositely facing handle and end knob portions. The elongated member, in its mostly preferred form, is generally cylindrical in cross-sectional shape and superficially resembles two baseball bats joined together end-to-end with their handle portions facing oppositely from each other. In an alternatively preferred embodiment, means are provided for selectively varying the weight of the exercising device. Various exercises also are disclosed for manipulating the member while walking or standing in place.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the annexed Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved exercising device and method for using same which has all of the advantages of the prior art and none of the disadvantages.

It is another object of the present invention to provide a new an improved exercising device which may be easily and efficiently manufactured and marketed.

It is a further objective of the present invention to provide a new and improved exercising device which is of durable and reliable construction.

An even further object of the present invention is to provide a new and improved exercising device which is susceptible of a low cost of manufacture with regard to both materials and labor, and which accordingly is then susceptible of low prices of sale to the consuming public, thereby making such exercising device available to the buying public.

Still yet a further object of the present invention is to provide a new and improved exercising device which may be held with both hands, or with one hand, while performing various exercises.

It is still a further object of the present invention is to provide a new and improved exercising device and method of using same to improve muscle tone, endurance, strength and self-confidence.

Still a further object of the present invention is to provide a new and improved exercising device which may be used while walling, running, or engaging in other physical exercising activities, and which serves the dual purpose of providing an intimidating self-defense weapon effective to deter or defeat criminal activities such as personal assaults.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 1 is a perspective view showing the first preferred embodiment of the exercising device of the invention being held by both hands of an exerciser.

FIG. 2 is an enlarged perspective view showing the first preferred embodiment of the exercising device of the invention.

FIG. 3 is a cross-sectional view of the exercising device of FIG. 2 taken along line 3—3 thereof.

FIG. 4 is a cross-sectional view of the exercising device of FIG. 3 taken along line 3—3 thereof.

FIG. 14 is a perspective view of a fourth preferred embodiment of the invention.

FIG. 15 is an exploded assembly in perspective view of the fourth preferred embodiment of the invention illustrated in FIG. 14.

FIG. 16 is a cross-sectional view of the exercising device of FIG. 14 taken along line 10—10 thereof.

DESCRIPTION OF THE PREFERRED EMBODIMENT

Figure 5:
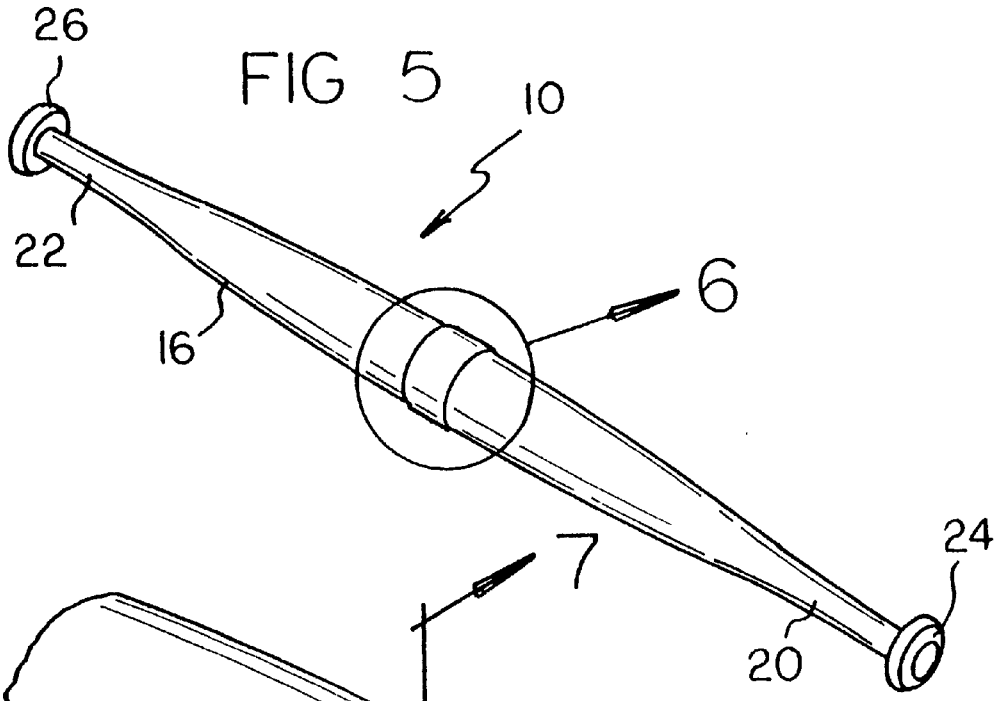
FIG. 5 is a perspective view of a second preferred embodiment of the invention.

With reference now to the drawings, a new and improved exercising device and method of using same embodying the principles and concepts of the present invention will be described.

Turning initially to FIGS. 1–4, there is shown a first exemplary embodiment of the exercising device of the invention generally designated by reference numeral 10 being held by both hands 12, 14 of an exerciser prior to commencing exercises therewith in accordance with the invention as will be further explained in more detail below.

In its preferred form, exercising device 10 comprises a longitudinally extending member 16 of generally cylindrical shape having an enlarged, substantially constant-diameter central portion 18 and a pair of oppositely extending reduced-diameter handle portions 20, 22 each of which terminates respectively in an oppositely facing, radially enlarged end or knob portion 24, 26 also of generally cylindrical shape. The enlarged end or knob portions 24, 26 are larger in diameter than handle portions 20, 22; and, preferably are of the same diametrical extent as central portion 18, but need not so be, i.e. they may be lesser or greater in diameter or transverse extent than central portion 18 inasmuch as their primary function is to serve as palm grips for the hands or to prevent the hands 12, 14 from slipping off handle portions 20, 22 during exercises therewith. For the sake of clarity, FIG. 1 shows the hands of an exerciser grasping the handle portions 24, 26. However, it is to be understood that many exercisers might be more comfortable grasping knob portions 24, 26 with the palms of the hands facing each other and bearing against the end surfaces of the konbs. Toward this end, and as shown, the knob end surfaces preferably are slightly convex in shape.

It will be noted further that each handle portion 20, 22 is joined to central portion 18 by a tapered intermediate portion 28, 30 and that the overall shape of exercising device 10 superficially resembles two "baseball bats" joined together enlarged-end-to-enlarged-end with their handle ends oppositely extending with respect to each other. Thus, when held by an exerciser with both hands as shown in FIG. 1, or with the palms of the hands facing each other and grasping the knobs 24, 26, the exercise device 10 being substantially symmetrical about a central plane passing orthogonally through the device (e.g. normal to the plane of FIG. 3) will feel perfectly balanced. This feature renders the device 10, in accordance with the invention, especially suitable for use in coordinated aerobic exercises during walking, running, or other physical exercising activities, as will be explained below.

The weight and size of device 10 is not critical and may vary depending upon size, age, and personal dictates of the individual exerciser. For the average adult, it has been found that a longitudinal extent (handle knob to handle knob) of about 30 inches will enable the exerciser to comfortably grasp the device with both arms extended in front of the body and parallel to each other and the ground, i.e. the position substantially as depicted in FIG. 1. The weight of the device is largely dependent upon the material from which it is fabricated. In the embodiment of FIGS. 1 through 4, the preferred material is wood, most preferably, white ash, turned to shape on a lathe from a solid piece of stock. In To illustrate and without limiting the invention in any way, an actual example of exercise device 10 was fabricated in the foregoing manner to the following specifications:

length: 29.50 inches
Maximum diameter: 1.75 inches
Minimum diameter: 1.00 inches
weight: 2.00 pounds By using a different wood material such as oak or other hardwood, the weight of an actual sample of the device 10 meeting the size specifications was increased to about 2.5 pounds.

Figure 6:
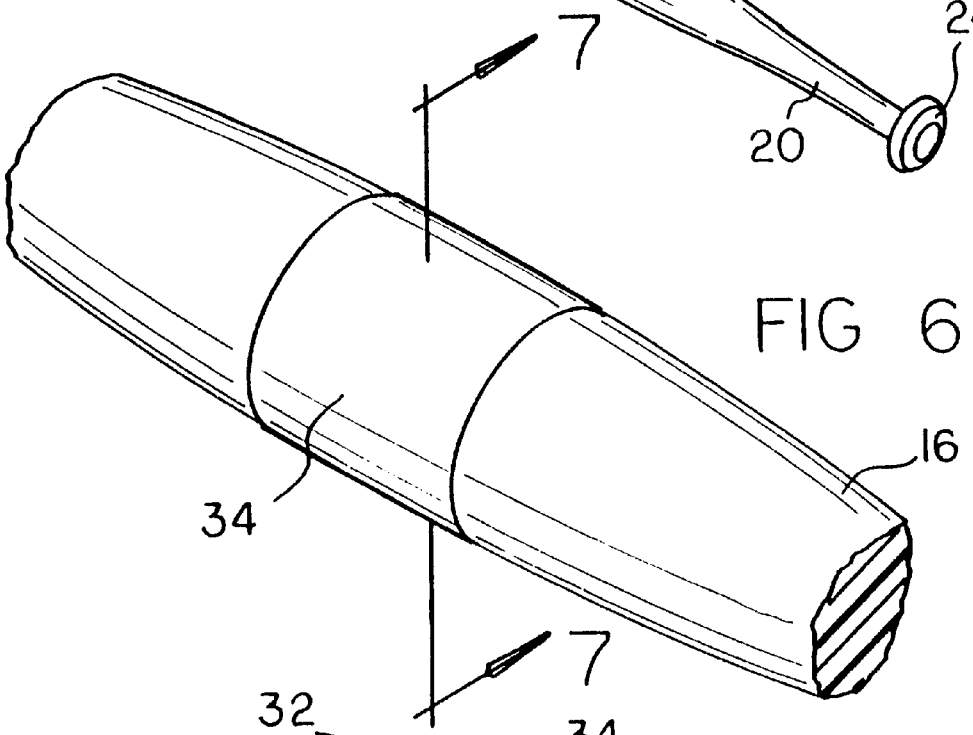
FIG. 6 is a perspective view of the medial portion of the second embodiment of the invention.
Figure 7:
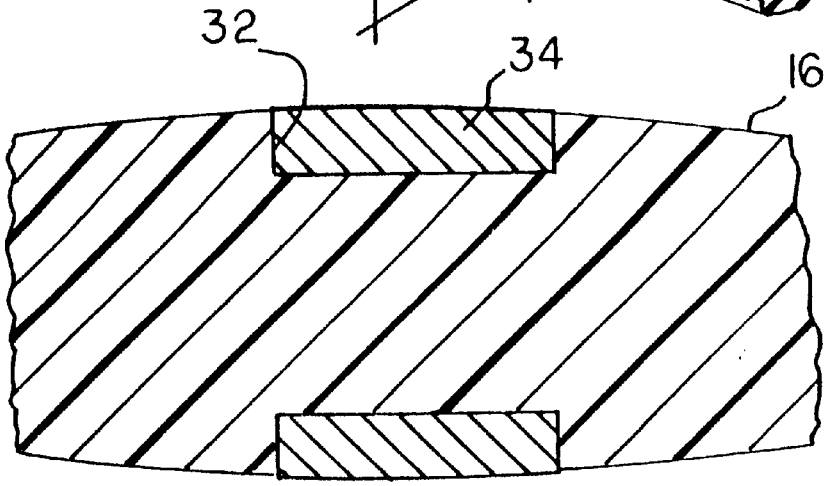
FIG. 7 is a cross-sectional view of the exercising device of FIG. 6 taken along line 6—6 thereof.

In certain situations, it may be desirable to utilize an exercise device 10 according to the invention having more weight without increasing its size. Thus, turning now to FIGS. 5 through 7, there is shown an alternatively preferred embodiment of the invention comprising a groove 32 circumferentially extending about the central portion 18 of member 16 and coaxially disposed with respect to the member's longitudinal axis. Groove 32, in turn, has disposed therein substantially as shown a hollow cylindrical sleeve 34 of dense material, preferably metal, serving as a weighted insert with the outwardly facing surface 36 of the cylindrical sleeve 34 being substantially flush with the outer cylindrical surface 36 of portion 18 of member 16. In this second exemplary embodiment of the invention, the sleeve 34 preferably is of one-piece construction whereas member 16 is preferably of a hard durable molded plastic material such as polyvinyl chloride or polypropylene and the two parts are assembled together in a suitable molding machine as is well understood. Alternatively, moldable hard rubber may be used instead. It should be apparent that the weight imparted to member 16 by means of metal sleeve 34 may be varied by changing the width and height of groove 32 and utilizing an insert of corresponding size (and weight). Hence, in this manner, a graduated series of exercise devices 10 may be provided each of different weight, albeit of similar-size. Since the metal sleeve 32 is located at a central position on member 16, the device 10 remains perfectly balanced as before. Alternatively, a pair of grooves 32 and a pair of corresponding sleeves 34 may be used equally spaced from an orthogonal plane passing through the midpoint of member 16 (i.e. normal to the plane of FIG. 7).

It is also within the contemplation of the invention to provide exercise member 10 with the facility of easily and rapidly changing or adjusting the weight thereof. This alternatively preferred form of the invention is illustrated in FIGS. 8 through 13 wherein the exercise device 10 is comprised of a pair of detachable members 16*a* and 16*b* each of which is approximately one-half the longitudinal extent of the device. First member 16*a* terminates at the end opposite handle portion 20 in a flat end surface 38 from which extends an integral, reduced-diameter externally threaded plug member 40 having a central blind hole 42 therein preferably of cylindrical cross-section substantially as shown. Hole 42 is adapted to slidably receive one of a series of cylindrically shaped weighted inserts designated respectively by reference numerals 44, 46, and 48. Each insert has a similar external size and shape, however they each differ in weight by the provision of a through bore of differing diameter. Thus, cylindrical weight 46 has a relatively large through bore 50, cylindrical weight 48 has a relatively small through bore 52, whereas cylindrical weight 44 has no through bore at all (i.e. it is solid). Obviously, weight 46 is lightest, weight 48 is next lightest, and weight 44 is heaviest.

Figure 8:
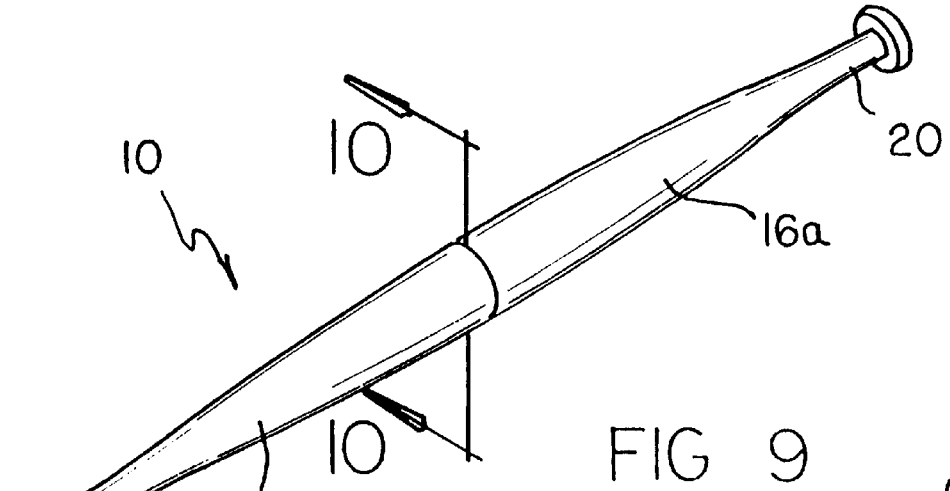
FIG. 8 is a perspective view of a third preferred embodiment of the invention.
Figure 9:
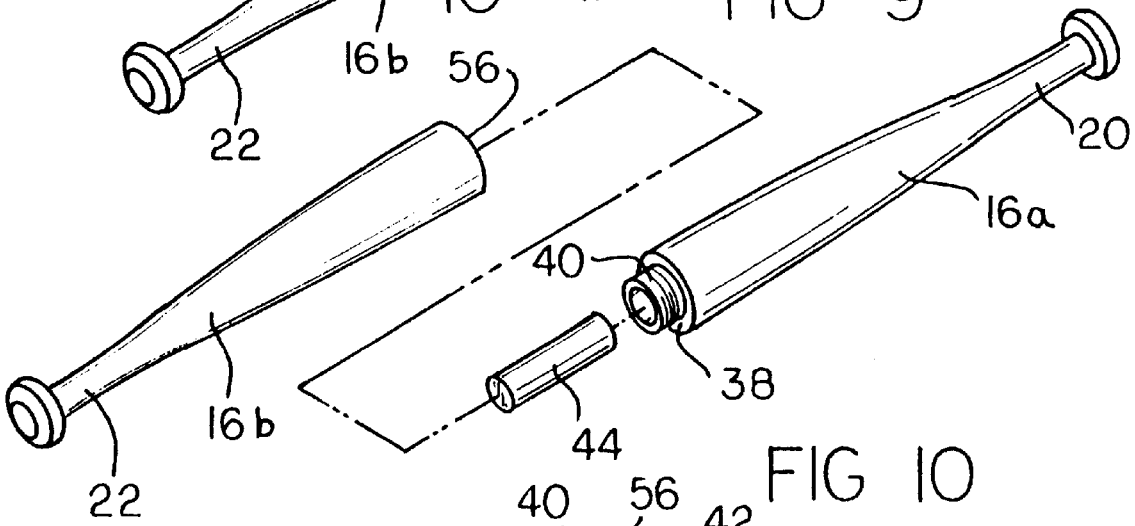
FIG. 9 is an exploded assembly in perspective view of the third preferred embodiment of the invention illustrated in FIG. 8.
Figure 10:
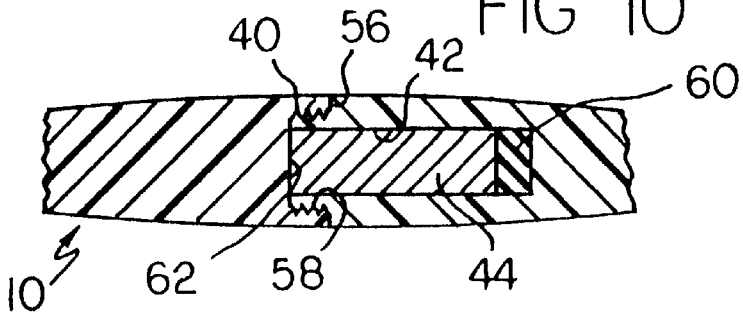
FIG. 10 is a cross-sectional view of the exercising device of FIG. 8 taken along line 10—10 thereof.
Figure 11:
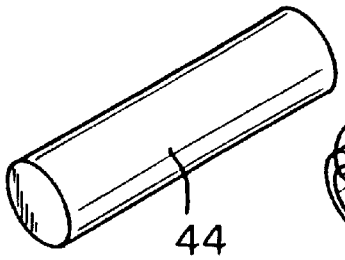
FIG. 11 is a perspective view of an insertable weight employed in the embodiment of FIGS. 8–10.
Figure 12:
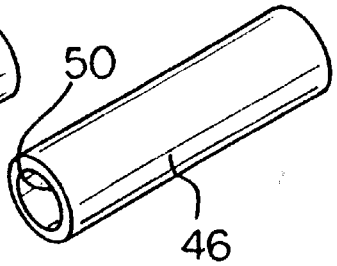
FIG. 12 is a perspective view of another insertable weight employed in the embodiment of FIGS. 8–10.
Figure 13:
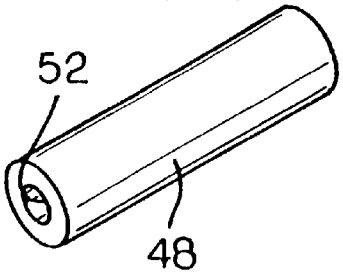
FIG. 13 is a perspective view of yet another insertable weight employed in the embodiment of FIGS. 8–10.

Second member 16*b* terminates at its end opposite handle portion 22 in a flat end surface 56 having a central female-threaded receptacle 58 therein adapted to matingly engage the complimentary externally or male-threaded plug member 40 when the latter is rotatably inserted into recess 58. When this is done the flat end surfaces 38, 56 will abuttingly engage each other and the two members 16*a*, 16*b* will be securely fastened to form the unitary exercising device 10 as shown in FIGS. 8 through 10. Before attaching the two members 16*a* and 16*b* together as aforementioned, the user may selectively insert any one of the inserts 44, 46, or 48 in blind hole 42 (or no insert at all) and thereby select the weight of exercising device 10 to be used during a series of exercises. To facilitate a quick and easy change of insert and to prevent the insert from moving within its receptacle defined by blind hole 42 when the members 16*a* and 16*b* are fastened together, a resilient member 60 preferably in the form of a compressible rubber disc is seated at the bottom of blind hole 42 and normally causes the distal end of an insert to protrude from blind hole 42 when members 16*a* and 16*b* are detached from each other thereby enabling the insert to be easily grasped by the fingers of the hand and removed. Of course, when members 16*a* and 16*b* are in their assembled condition, the bottom surface 62 of receptacle 58 will bear against the distal end of the insert and cause the latter to compress resilient member 60, which compression furthermore enhances the connection between the mating threaded parts of plug member 40 and receptacle 58. It thus will be appreciated that the weight of exercise device 10 selectively may be changed in a simple and rapid manner to suit the particular exercise being conducted therewith, or the exerciser's particular preference. Alternatively, the weight of the exercise device according to the invention selectively may be gradually increased or decreased over successive repetitions of the same or similar exercise as desired.

Instead of providing a pair of connectable/detachable members 16*a* and 16*b* of substantially equal longitudinal extent as described above in connection with the embodiment of FIGS. 8 through 10, the two members may be of unequal longitudinal extent as shown in the alternatively preferred embodiment of FIGS. 14 through 16. As illustrated in this exemplary form of the invention, handle portion 16*a* is relatively shorter in longitudinal extent than is member 16*b*. More specifically, handle portion 16*a* has an end face 64 from which extends longitudinally an integral plug member 66 having external threads thereon for matingly engaging the complimentary threads on the front end portion of a longitudinally extending receptacle 68 which extends from the end face 70 on member 16*b* to beyond the midpoint of the unitary device 10 ultimately terminating in a receptacle end 72 against which resilient member or disc 60 reposes. The cylindrically shaped weighted insert 44 (or inserts 46, 48) may be slidably received in receptacle 68 and positioned substantially at the center of the unitary device 10 by means of a cylindrical filler rod 74 integrally attached to the distal end of plug member 66 when handle portion 16*a* is rotatably attached to member 16*b* in a manner believed apparent from the above description.

Alternatively, device 10 may be fitted with a second removable handle portion on the left side thereof identical to handle portion 16*a* and receptacle 68 made to extend completely longitudinally through member 16*b*. With this three-piece variation, the filler tubes may be shortened and a series of two or more weights placed longitudinally end-to-end within through-receptacle 68 to thereby provide an exercise device of even additionally increased weight.

Moreover, it will be appreciated that the alternatively preferred embodiments of FIGS. 8 through 16, and the additionally modified variant described above, but not shown, have the further advantage of being disassembled into a plurality of smaller parts thereby enabling the device to be more compactly stored when it is not in use or during travel.

Turning now to FIGS. 17 through 22, various preferred exercises using the device 10 in accordance with the invention now will be described.

Figure 17:
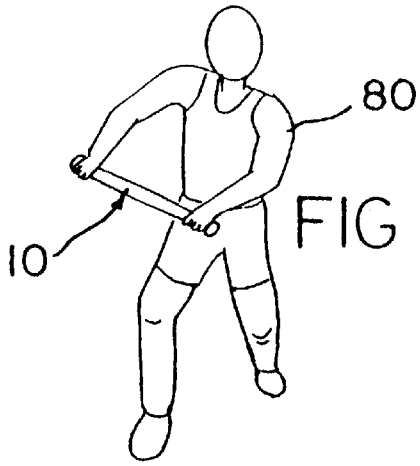
FIG. 17 is a diagrammatic view of an exerciser using the exercising device of the invention in accordance with a method of the invention.
Figure 18:
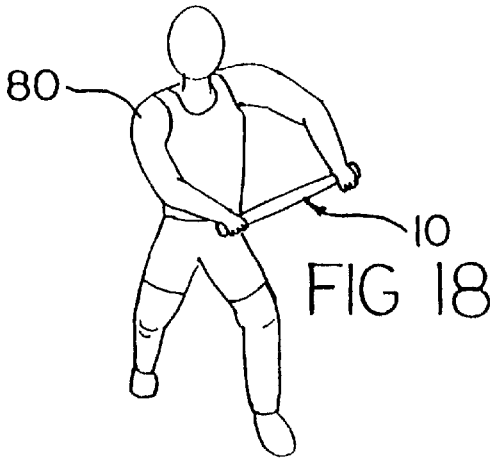
FIG. 18 is a diagrammatic view of an exerciser using the exercising device of the invention in accordance with a method of the invention.

FIGS. 17 and 18 show the exerciser 80 holding the device 10 with both arms slightly extended in front of the body and both hands grasping the handle portions 20, 22 (see also FIG. 1). The exerciser swings the device 10 in a smooth pendulum motion from one side of the body to the other side while marching in place to warm up. The exerciser then walks at a selected pace moving the exercise device 10 in synchronism with the feet, i.e. the device is swung to the right side as the right foot moves forward (FIG. 17) and then to the left side as the left foot moves forward (FIG. 18).

Figure 19:
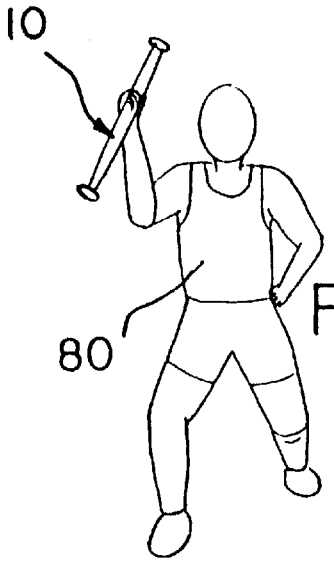
FIG. 19 is a diagrammatic view of an exerciser using the exercising device of the invention in accordance with a method of the invention.
Figure 20:
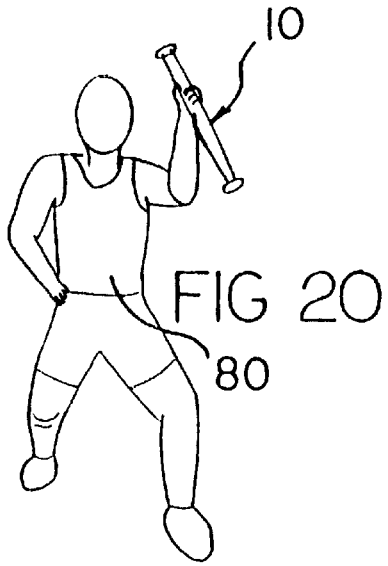
FIG. 20 is a diagrammatic view of an exerciser using the exercising device of the invention in accordance with a method of the invention.

FIGS. 19 and 20 show the exerciser holding device 10 in the middle thereof with one knob end near the elbow. While walking or marching in place, the exerciser swings the right arm above the head until full extension of the arm is reached and the device is parallel to the ground. Five to fifteen repetitions are performed and the device switched to the left hand to repeat the exercise. Increased weight, using a heavier version of device 10, and/or more repetitions are added as strength, endurance and confidence are developed.

Figure 21:
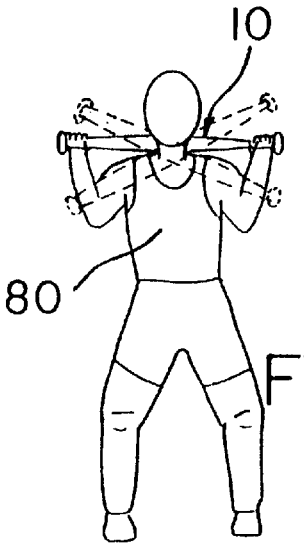
FIG. 21 is a diagrammatic view of an exerciser using the exercising device of the invention in accordance with a method of the invention.

FIG. 21 shows the exerciser holding device 10 behind the neck with both hands. The exerciser twists at the waist first to one side of the body then to the other side. The number of repetitions and/or amount of weight are gradually increased.

Figure 22:
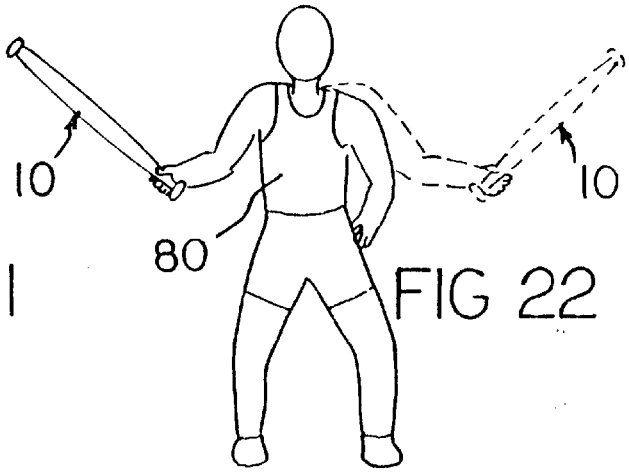
FIG. 22 is a diagrammatic view of an exerciser using the exercising device of the invention in accordance with a method of the invention.

FIG. 22 shows the exerciser 80 holding the device 10 in one hand grasping it at one end arm portion and having the device extend upwardly away from the body at approximately a forty-five degree angle with elbow slightly bent (dueling position). Keeping the arm relatively stiff in this position, the body is twisted at the waist and the arm swung across the body to the other side. After a number of repetitions the device is switched to the other hand and the exercise repeated. The number of repetitions and/or amount of weight are gradually increased.

Although the primary purpose of exercise device 10 and of the exercises to be performed with exercise device 10, as described above, is to improve muscle tone, aerobic endurance, self-confidence and to increase motivation to exercise regularly and keep physically fit, it will be further appreciated that the exercising device 10 according to the present invention serves a dual purpose, namely, as a potential club-like weapon which may, if need be during walking or exercising outside the safety of a home or protected facility, effectively be employed in an obvious manner to thwart off a would be mugger, vicious animal, or other similar threat to personal safety.

Hence, it should now be evident from the above description that the present invention accomplishes all of the objectives set forth by providing a new and improved exercising device which may be held with both hands, or with one hand, while performing various exercises, and which, in alternatively preferred form, includes means for permitting the quick and easy addition or subtraction of weight thereto. In addition, it has been shown that when used in accordance with various physical exercises or methods, the unique exercise device of the invention is effective to improve muscle tone, aerobic endurance, strength and self-confidence, and enhances motivation to maintain a program of physical exercise leading to improved health and well being. Finally, it has been shown that the new and improved exercising device of the invention serves the dual purpose of providing an intimidating self-defense weapon effective to deter or defeat criminal activities such as personal assaults, or attacks by vicious animals, when the exercising efforts are performed in public.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved exercise device comprising:

an elongated member, said elongated member having first and second longitudinally spaced handle portions extending oppositely from a central portion therebetween whereby an individual may grasp either of said handle portions or said central portion during physical activity, and said central portion having a transverse dimension greater than the transverse dimensions respectively of said handle portions, wherein said handle portions each terminates in a knob and said elongated member resembles a pair of baseball bats joined together end-to-end, and wherein said elongated member includes means for selectively adjusting the weight thereof;

wherein said elongated member comprises first and second members removably attached to each other, said first member having a receptacle therein and said means for selectively adjusting the weight thereof comprises a weighted element insertable within said receptacle.

2. The invention of claim 1 wherein said weight means comprises a metal cylindrical sleeve disposed in said groove wherein the outside surface of said sleeve is substantially flush with respect to the outside surface of said central portion proximal to said groove.

3. The invention of claim 1 wherein said weighted element comprises a cylinder adapted to be received within said receptacle.

4. The invention of claim 3 wherein said weighted element is selected from a group consisting of similarly sized cylinders of differing weight.

5. The invention of claim 4 wherein said similarly sized cylinders comprise a first solid cylinder, a second cylinder having a through-bore of first diameter, and a third cylinder having a through-bore of second diameter different from said first diameter bore.

6. The invention of claim 1 wherein said first member has an end face at the end thereof opposite to one of said handle portions, a plug member extending from said end face, said plug member having an external male threaded fastening surface, said plug further having said receptacle therein for receiving said weighted element, and wherein said second member has an end face at the end thereof opposite to the other of said handle portions, a recess in said second member end face having an internal female threaded fastening surface, said recess adapted to matingly receive said plug member therein when said first member is rotatingly engaged with said second member to form said elongated member with said weighted element received within said receptacle.

7. The invention of claim 6 wherein said end face on said first member abuttingly engages said end face on said second member to form a seam at the midpoint of said elongated member.

8. The invention of claim 1 wherein said first member has an end face at the end thereof opposite to one of said handle portions, a plug member extending from said end face, said plug member having an external male threaded fastening surface, said plug further having a filler rod extending longitudinally and distally from said plug member and wherein said second member has an end face at the end thereof opposite to the other of said handle portions, a recess in said second member end face having an internal female threaded fastening surface proximal to said second member end face, said recess defining said receptacle for receiving said weighted element and further being adapted to matingly receive said plug member and said filler rod therein when said first member is rotatingly engaged with said second member to form said elongated member with said weighted element received within said receptacle.

9. The invention of claim 8 wherein said end face on said first member abuttingly engages said end face on said second member to form a seam between the midpoint of said elongated member and said one handle portion.

* * * * *